US007343883B2

(12) United States Patent
Emmersberger

(10) Patent No.: US 7,343,883 B2
(45) Date of Patent: Mar. 18, 2008

(54) COOLANT PUMP ARRANGEMENT FOR AN INTERNAL-COMBUSTION ENGINE

(75) Inventor: Georg Emmersberger, Pfaffing (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 7 days.

(21) Appl. No.: 11/492,774

(22) Filed: Jul. 26, 2006

(65) Prior Publication Data

US 2006/0254539 A1 Nov. 16, 2006

Related U.S. Application Data

(63) Continuation of application No. PCT/EP2004/014043, filed on Dec. 9, 2004.

(30) Foreign Application Priority Data

Jan. 27, 2004 (DE) ..... 10 2004 004 050

(51) Int. Cl.
*F01P 5/10* (2006.01)

(52) U.S. Cl. ..... 123/41.44

(58) Field of Classification Search ..... 123/41.44, 123/41.45, 41.46, 198 C, 198 DA, 41.47
See application file for complete search history.

(56) References Cited

FOREIGN PATENT DOCUMENTS

| | | | |
|---|---|---|---|
| DE | 34 09 605 | A1 | 9/1985 |
| DE | 38 41 409 | A1 | 10/1989 |
| DE | 38 18 359 | C2 | 5/1991 |
| DE | 199 41 891 | A1 | 3/2000 |
| DE | 199 45 948 | A1 | 4/2001 |
| DE | 203 05 562 | U1 | 7/2003 |
| EP | 0 835 991 | A2 | 4/1998 |
| GB | 1 567 303 | | 5/1980 |
| JP | 61-38129 | A | 2/1986 |
| WO | WO 02/064958 | A1 | 8/2002 |

OTHER PUBLICATIONS

International Search Report dated May 4, 2005 with English Translation (six (6) pages).

German Search Report dated Dec. 29, 2004 with an English translation of the pertinent portion (five (5) pages).

*Primary Examiner*—Hai Huynh
(74) *Attorney, Agent, or Firm*—Crowell & Moring LLP

(57) ABSTRACT

A coolant pump arrangement for an internal-combustion engine of a motor vehicle is provided, which includes engine shafts. The coolant pump arrangement encompasses a pump housing and a pump shaft, one end of which is provided with a pump impeller. The pump shaft is essentially cantilevered by way of a bearing that is disposed inside the internal combustion engine.

15 Claims, 2 Drawing Sheets

COOLANT PUMP ARRANGEMENT FOR AN INTERNAL-COMBUSTION ENGINE

CROSS-REFERENCE TO RELATED APPLICATIONS

This application is a continuation of PCT International Application No. PCT/EP2004/014043, filed on Dec. 9, 2004, which claims priority under 35 U.S.C. §119 to German Application No. 10 2004 004 050.8, filed Jan. 27, 2004, the entire disclosures of which are expressly incorporated by reference herein.

BACKGROUND AND SUMMARY OF THE INVENTION

The invention relates to a coolant pump arrangement for an internal-combustion engine of a motor vehicle including engine shafts. The coolant pump arrangement includes a pump housing and a pump shaft, one end of which is provided with a pump impeller.

Conventionally, the required cooling of motor vehicle internal-combustion engines takes place by use of a coolant, such as water, which circulates in a coolant circulation system and absorbs heat in areas to be cooled and releases this heat again at a different point by way of heat exchangers. Pumps are provided for circulating the coolant.

German Patent document DE 199 41 891 A1, for example, describes a water pump arrangement of this type. Accordingly, the water pump has a pump housing, which is formed of a pump body and a pump covering, and which is connected with the crank case of the internal-combustion engine. The pump shaft is accommodated in the pump housing and is rotatably disposed in a shaft supporting section. The shaft supporting section has a length corresponding to three times the pump shaft diameter and is acted upon by oil for lubrication. The lubricating oil is fed from the crankcase by way of an oil feeding opening. For sealing off the pump space, a sealing device is provided, which axially adjoins the shaft supporting section.

Because of the pump shaft bearing and, in addition, as a result of the sealing device axially adjoining the latter, this water pump arrangement has a very long dimension, which may be disadvantageous, depending on the installation position, particularly when the internal-combustion engine is used in a motorcycle. Also, long coolant hoses are required for connecting the water pump.

An internal-combustion engine having an engine shaft, which is to accommodate as many components as possible relevant to the operation of the engine, is shown and described in German Patent document DE 199 45 948 A1. In addition to mass balance weights, this engine shaft accommodates an impeller on an end side for circulating coolant, the water pump housing being integrated as a function of the arrangement of the engine shaft in the crankcase or in the cylinder head.

Such an integration of the water pump arrangement in the crankcase or the cylinder head requires a high expenditure construction, for example, with a T-joint on the cylinder head, a special seal and/or additional bearings. Also, a special machining of the cylinder head is required, and the pump arrangement cannot be uncoupled.

It is, therefore, an object of the invention to further develop a cooling pump arrangement of the above-mentioned type with a view to a compact, short internal-combustion engine, particularly for a use in a motorcycle, while simultaneously providing a simple and maintenance-friendly construction.

This object is achieved by a coolant pump arrangement for an internal-combustion engine of a motor vehicle including engine shafts, having a pump housing and a pump shaft with a pump impeller arranged on one end, wherein an essentially cantilevered bearing of the pump shaft is provided by a bearing arranged inside the internal-combustion engine. The basic idea is the essentially cantilevered bearing of the pump shaft by way of a bearing arranged within the internal-combustion engine. According to the invention, the bearing is arranged inside the internal-combustion engine in the cylinder head or in the crankcase.

Particularly preferred embodiments and further developments of the invention are described and claimed herein.

According to a particularly advantageous embodiment of the invention, the pump shaft is non-rotatably and coaxially connected with an engine shaft driving it, particularly with a camshaft. The rotational water pump speed and, thus also the pumping capacity, are therefore directly dependent on the rotational speed of the internal-combustion engine. According to another embodiment, the pump shaft is drivable indirectly or directly by another engine shaft.

The bearing of the pump shaft expediently takes place by way of the last engine shaft bearing arranged adjacent to the pump arrangement. If the pump shaft is connected with a camshaft, the last camshaft bearing is simultaneously the bearing element for the pump shaft carrying the pump impeller.

In a preferred embodiment of the invention, a sealing device, particularly a slide ring seal, is arranged between the pump housing and the pump shaft, by which slide ring seal, a centering takes place simultaneously. The slide ring seal is further developed in the manner of a tube section and, by way of its radially interior surface seals off against the pump shaft. By way of its radially exterior surface the sealing device is supported on the inside radius of a receiving device on the pump housing, on the one side, and in a centering manner on the inside radius of a receiving device on the crankcase, on the other side.

It is considered to be very expedient for fixing the pump impeller and the pump shaft on the engine shaft by way of a screwed connection to construct the pump shaft to be hollow and the engine shaft to have a thread on an end side. In this case, the pump shaft is centered on the inside and the outside on the engine shaft.

Other objects, advantages and novel features of the present invention will become apparent from the following detailed description of the invention when considered in conjunction with the accompanying drawings.

DETAILED DESCRIPTION OF THE DRAWINGS

Figure 1:
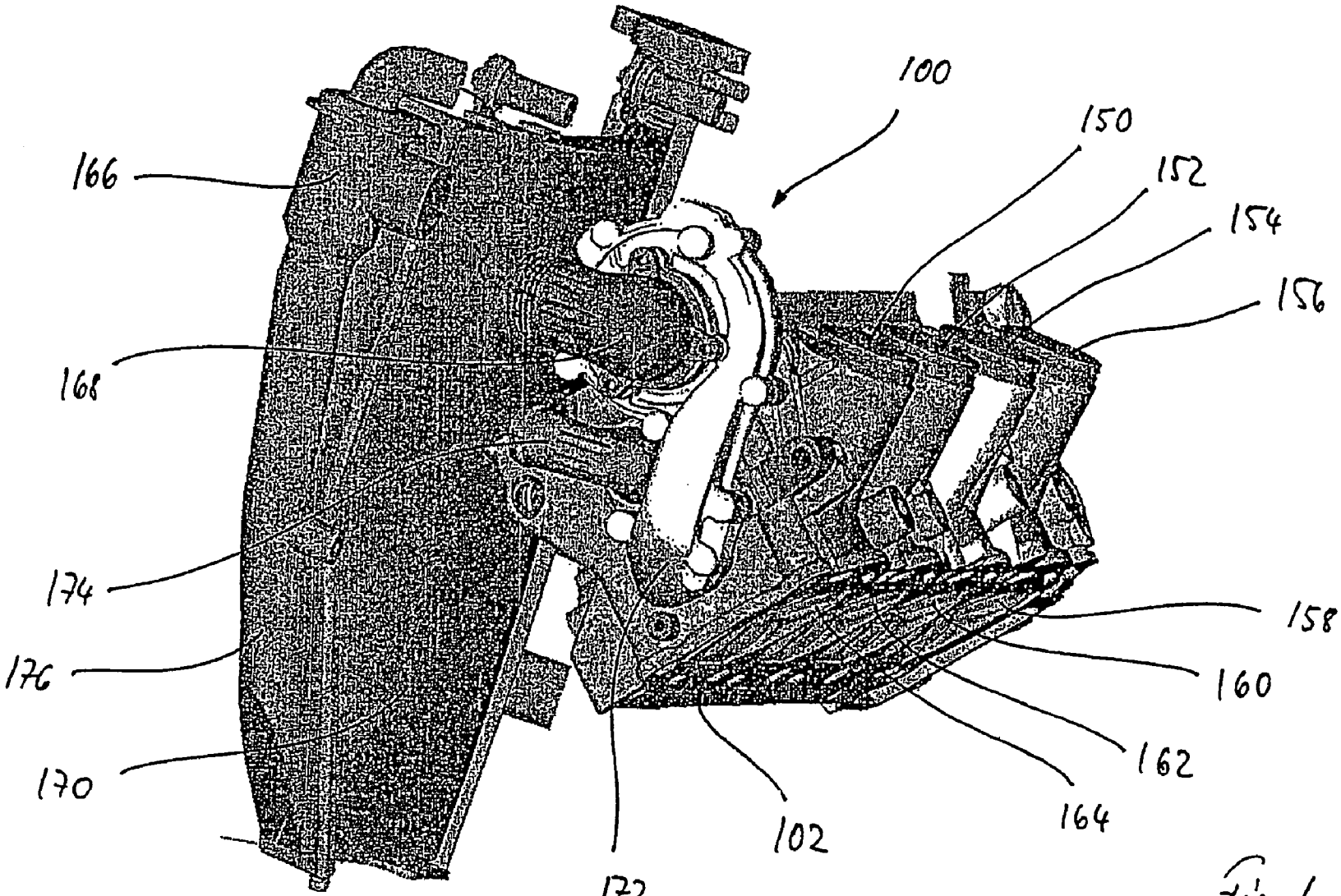
FIG. 1 is a schematic view of an embodiment of a coolant pump arrangement according to the invention for an internal-combustion engine of a motor vehicle.

FIG. 1 illustrates a coolant pump arrangement 100 for an internal-combustion engine of a motor vehicle (not shown here in detail). In this case, shown is an in-line four-cylinder engine for a motorcycle. On the face-side, the coolant pump arrangement 100 is connected with the cylinder head 102 of the internal-combustion engine, the internal-combustion engine being installed transversely to the driving direction, so that the individual cylinders are situated side-by-side with the head inclined diagonally toward the front. The coolant pump arrangement 100 is therefore arranged on the left in the driving direction. The charging of the cylinders takes place by intake connection pieces 150, 152, 154, 156 from above, while the combustion exhaust gases are discharged diagonally downward to the front. Correspondingly, the intake camshaft for operating the intake valves 158, 160, 162, 164 is situated at the top.

The coolant pump arrangement 100 includes a suction connection piece 168, through which coolant, such as cooling water, is taken in by way of the thermostat 166 of the radiator 170. In the area 172, the coolant is fed to the water cooling jacket, in which case a distribution of the coolant flow takes place into a main flow for cooling the cylinder head 102 and a partial flow for cooling the crankcase. If a cooling of the internal-combustion engine, for example, during the warm-up phase, is not (yet) required, the coolant will flow, corresponding to a forward flow control, on the basis of a thermostat position, while bypassing the radiator 170, directly by way of the short-circuit connection piece 174 back to the suction connection piece 168. Only when a defined temperature has been reached, will the thermostat 166 control the short-circuit flow such that the suction connection piece 168 is acted upon while including the radiator 170 by way of the pipe 176.

Figure 2:
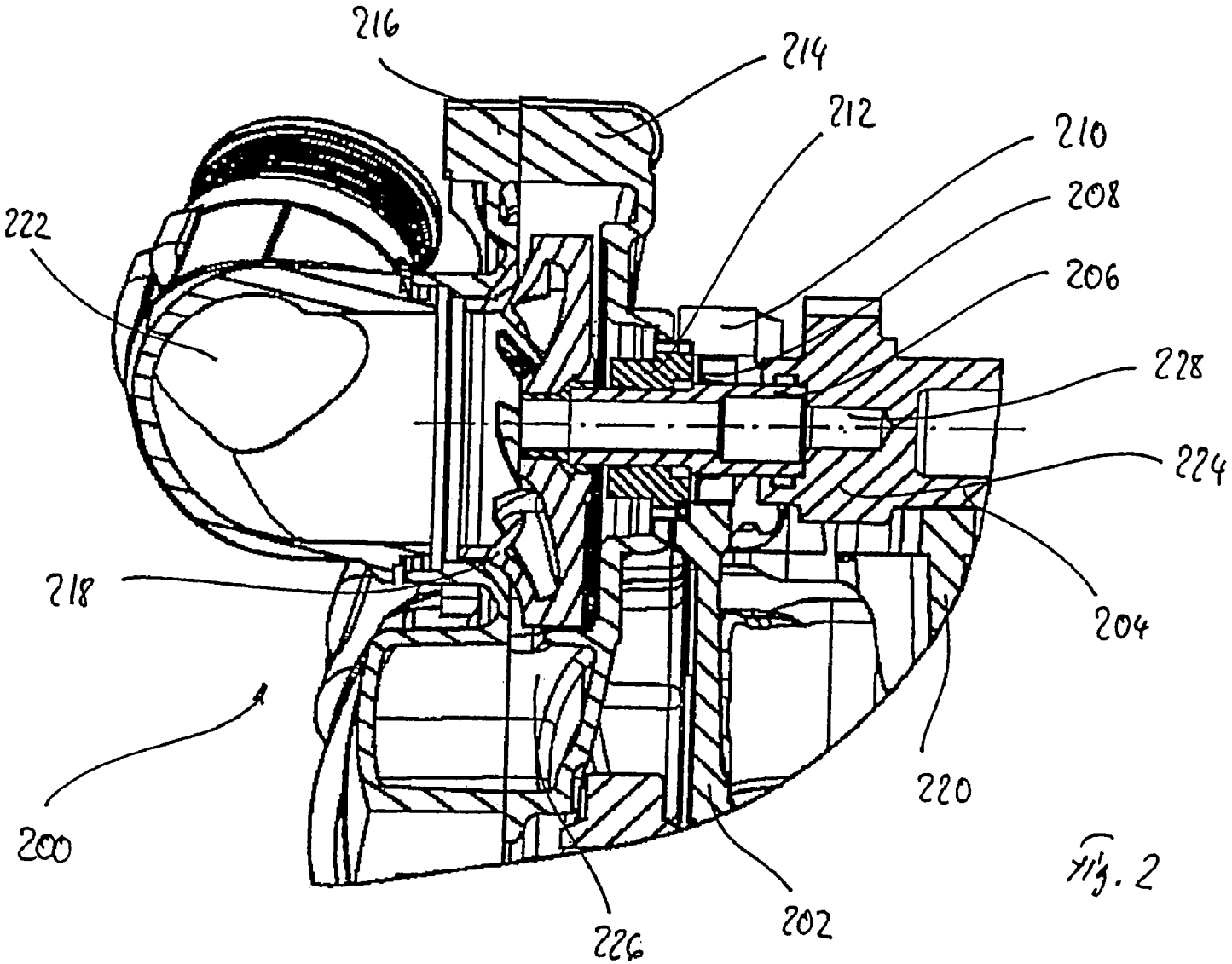
FIG. 2 is a schematic sectional view of a detail of a coolant pump arrangement according to the invention for an internal-combustion engine of a motor vehicle.

FIG. 2 is a sectional view of a detail of a coolant pump arrangement 200 for an internal-combustion engine of a motor vehicle. The coolant pump arrangement 200 is connected on the face side with the cylinder head 202 of the internal-combustion engine and takes in coolant through a suction connection piece 222. The delivery side of the radial flow pump has the reference number 226. For the bearing of the camshafts, the cylinder head 202 has shell-type bearings which receive the camshafts. The bearings are closed by means of bearing bridges (not shown here). The figure shows the last bearing 220 on the end side of the intake camshaft 204 adjacent to the cam 224.

The coolant pump shaft 206 is coaxially connected with the intake camshaft 204. In this case, a screw through the hollow coolant pump shaft 206 in a thread 228 at the camshaft end provides a frictional connection between the pump impeller 218, the pump shaft 206 and the camshaft 204. A centering of the pump shaft 206 takes place as above on the camshaft on the inside or, as an alternative, on the outside. The coolant pump housing 214 is equipped with a pressed-in standard sliding ring seal 212 and is screwed to the cylinder head 202, in which case the housing of the slide ring seal 212 is used for centering to the camshaft bearing axis in the cylinder head 202. The coolant pump cover 216 is connected with the coolant pump housing 214. The cylinder-head-side oil tightness is achieved by way of a shaft sealing ring 208 pressed in between the coolant pump bearing cover 210 and the cylinder head 202.

The bearing 220 of the intake camshaft 204, which is the last at the end side and is adjacent to the cam 224, is simultaneously the bearing element for the cantilevered pump shaft 206 carrying the pump impeller 218. A separate bearing for the pump shaft 206 is therefore not required, so that the length of the internal-combustion engine may be reduced considerably. Particularly in the case of an in-line four-cylinder system installed transversely into a motorcycle, this represents a significant improvement. Because of the compact dimension and the resulting small projected area in the driving direction, special advantages are achieved with respect to aerodynamics, consumption, acceleration and final speed. Furthermore, the required space, weight and costs are reduced. Particularly on the basis of the installation position, which is transversely and diagonally inclined toward the front, a connection can be established by way of very short hoses between the radiator and the cylinder head 202 arranged directly behind it, or the coolant pump. In addition to the above-mentioned advantages, there are also advantages with respect to the design.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A coolant pump arrangement for an internal-combustion engine of a motor vehicle, comprising:

a bearing disposed inside the internal-combustion;

a pump housing;

a pump shaft, one end of which is provided with a pump impeller; and wherein the pump shaft is essentially cantilevered by way of the bearing inside the engine, and the cantilevered bearing of the pump shaft takes place by use of a last engine shaft bearing arranged adjacent to the coolant pump arrangement.

2. The coolant pump arrangement according to claim 1, wherein the pump shaft is coaxially connected with an engine shaft.

3. The coolant pump arrangement according to claim 2, wherein the engine shaft is a camshaft.

4. The coolant pump arrangement according to claim 3, further comprising:

a sealing device arranged between the pump housing and the pump shaft, by which sealing device, a centering takes place simultaneously.

5. The coolant pump arrangement according to claim 3 wherein for fixing the pump impeller and the pump shaft on the engine shaft by a screwed connection, the pump shaft has a hollow construction and the engine shaft has a thread at an end side.

6. The coolant pump arrangement according to claim 2, further comprising:

a sealing device arranged between the pump housing and the pump shaft, by which sealing device, a centering takes place simultaneously.

7. The coolant pump arrangement according to claim 2 wherein for fixing the pump impeller and the pump shaft on the engine shaft by a screwed connection, the pump shaft has a hollow construction and the engine shaft has a thread at an end side.

8. The coolant pump arrangement according to claim 1, further comprising:

a sealing device arranged between the pump housing and the pump shaft, by which sealing device, a centering takes place simultaneously.

9. The coolant pump arrangement according to claim 8, wherein for fixing the pump impeller and the pump shaft on the engine shaft by a screwed connection, the pump shaft has a hollow construction and the engine shaft has a thread at an end side.

10. The coolant pump arrangement according to claim 1, wherein for fixing the pump impeller and the pump shaft on the engine shaft by a screwed connection, the pump shaft has a hollow construction and the engine shaft has a thread at an end side.

11. A coolant pump arrangement for an internal-combustion engine of a motor vehicle, comprising:

a bearing disposed inside the internal-combustion engine supporting a shaft;

a pump housing;

a pump shaft, one end of which is provided with a pump impeller and another end is coupled to the shaft; and wherein the pump shaft is essentially cantilevered by way of the bearing inside the engine.

12. The coolant pump arrangement according to claim 11, wherein the cantilevered bearing of the pump shaft comprises a last engine shaft bearing arranged adjacent to the coolant pump arrangement.

13. The coolant pump arrangement according to claim 11, wherein the shaft is a camshaft.

14. The coolant pump arrangement according to claim 11, further comprising a sealing device arranged between the pump housing and the pump shaft for simultaneously sealing and centering the pump shaft.

15. The coolant pump arrangement according to claim 11, wherein the pump shaft is hollow and the engine shaft comprises a threaded end for fastening the pump shaft to the engine shaft.

* * * * *